US007882793B1

(12) United States Patent
Paulus

(10) Patent No.: US 7,882,793 B1
(45) Date of Patent: Feb. 8, 2011

(54) LIGHTWEIGHT ANCHOR FOR SMALL WATERCRAFT

(76) Inventor: Robert D. Paulus, 851 217th St., Osceola, WI (US) 54020

( * ) Notice: Subject to any disclaimer, the term of this patent is extended or adjusted under 35 U.S.C. 154(b) by 29 days.

(21) Appl. No.: 12/584,767

(22) Filed: Sep. 10, 2009

(51) Int. Cl.
*B63B 21/24* (2006.01)

(52) U.S. Cl. ..... 114/301; 114/294

(58) Field of Classification Search ..... 114/293–310
See application file for complete search history.

(56) References Cited

U.S. PATENT DOCUMENTS 5,410,981 A * 5/1995 Gutstein et al. ..... 114/294
2002/0026890 A1* 3/2002 Zook et al. ..... 114/294

* cited by examiner

*Primary Examiner*—Ed Swinehart
(74) *Attorney, Agent, or Firm*—Michael J. Tavella

(57) ABSTRACT

An anchor for small watercraft. It is extremely lightweight, and can be stored in a very small space. The anchor consists of a pear-shaped fabric ballast container. This container is made up of a number of matching side panels and a circular bottom disc. A set of four metal or composition flukes attached to the ballast container near the bottom and at the widest part of the container. Each fluke is about 9-11" long, ¾" wide, ½" thick, with an angled tip at one or both ends. The flukes are thus deployed by weighting the bag with material like gravel or sand, which forces the flukes to protrude sharp angle from the ballast bag. When filled with material, the anchor approximates the function of traditional fluke or bell anchors. The anchor can be turned inside out for self-storage, requiring no additional storage container.

14 Claims, 9 Drawing Sheets

LIGHTWEIGHT ANCHOR FOR SMALL WATERCRAFT

CROSS REFERENCE TO RELATED APPLICATIONS

This application claims benefit of Provisional application 60/815,128 filed Jun. 19, 2006.

STATEMENT REGARDING FEDERALLY SPONSORED RESEARCH AND DEVELOPMENT

Not Applicable

BACKGROUND OF THE INVENTION

1. Field of the Invention

This invention relates to lightweight anchors for small watercraft and particularly to lightweight anchors for small watercraft having bags to load with weighty material.

2. Description of the Prior Art

There are several anchor styles available on the market. Most common are the kedge anchor, the Danforth-style fluke anchor, a plow-kind of device, the grapnel, and the cast bell anchor. All come in a variety of weights to be selected relative to the size of craft and demands placed on the anchor. A kedge anchor consists of a single casting including a shaft and a single bent bar with pointed blades on the ends. At the end of the shaft where the line is attached, an eye is located in the casting. Through the eye, a crossbar is installed at 90 degree angles to the bar with the flukes. When drawn across the bottom, the crossbar on the line end rotates the anchoring bar so one of the flukes is pointed down into the bottom, causing it to dig in. The Danforth-style is common on many kinds of watercraft and ships. It consists of a main shaft connected at one end with the anchor line or chain, and at the other end, has a hole through which a bar extends to either side of the main shaft. To this bar, triangular shaped cast or welded blades are attached. The main shaft of the anchor has projections that limit the radius through which the blade bar can rotate; setting the angle the blades can take into the bottom.

The plow anchor looks very similar to a farm implement. It has a winged pointed blade fixed to a shaft shaped like a fishhook. When dragged across the bottom, the plow is expected to bury itself into the material and anchor the watercraft. The grapnel anchor has a central shaft with a number of cast individual flukes pinned to a hub at the end of the shaft casting. The flukes fold against the shaft for compact storage. The bell anchor, designed almost entirely for small personal fishing and recreational craft. It is a cast mushroom shape with no moving parts. Its function is strictly as a drag, and is probably the least functional common anchoring device.

Some more recent technology includes anchors designed for personal watercraft. Among these, there is a 3.5-pound grapnel anchor, coated with vinyl. There is a 2.5-pound Danforth-style fluke anchor, also coated with vinyl. Another item is a drum-shaped sandbag, with a drawstring top. It has no flukes or other external fittings.

There has always been a need for a very lightweight, compact device for anchoring small craft such as canoes, kayaks, duck boats and other small watercraft. Historically, anchors have been variously heavy, bulky, always underfoot, and capable of damaging the watercraft that hauled or used them. Because of their basic material and construction, frequently a decision had to be made before each outing as to whether the need for an anchor was probably going to necessitate lugging one along. Experience has indicated that if weight and portability was important, as on canoe portages, the anchor was left at home. Frequently, such trips had occasions that would have used an anchor.

BRIEF DESCRIPTION OF THE INVENTION

The invention is a fabric ballast container with rigid flukes that forms an anchor for small watercraft. It is extremely lightweight, and can be stored in a very small space. The anchor consists of two basic components. The first component is a pear-shaped fabric ballast container. This container is made up of a number of matching side panels and a circular bottom disc. The size of the container is about 12" tall, 4" in diameter at the top and base, and about 6" in diameter at the widest point. The widest point is about 4" above the bottom. At the bottom and at the widest point (between 3.5" and 4.5" above the bottom), loops of webbing are sewn into the seam joining the side panels. These loops are used to stabilize each fluke by fitting tightly into corresponding notches formed in the flukes. The second component is a set of metal or composition flukes attached near the bottom and at the widest part of the ballast container. Each fluke is about 11" long, ¾" wide, ½" thick, with a curve or flare at the tip and heel. The tip extends about 4" above the retaining strap (at the widest point of the container). The curved barbed end at the heel extends about 2" below the bottom of the ballast container. Note that the design of the flukes can vary to suit different applications.

This design is the only anchoring device that combines a soft ballast container with hard flukes. Filling the container extends the flukes and creates a functional anchor whenever an anchor is needed. Another significant advantage is that the ballast bag can be turned inside out, flukes inside, for storage.

This anchor solves the dilemma of trying to haul a steel or iron device with sharp points around in a watercraft without causing damage to the craft or the passengers. Because this anchoring device weighs only about a third of a pound empty and stores with the flukes inside the ballast bag, it has none of the drawbacks usually associated with anchors. It is strong, inexpensive, and a highly portable anchor device. It has no iron or steel parts, so it is usable in either fresh or salt water. The weight of the anchor can be selected by the user to fit the situation. A weight of about 7 pounds is enough to extend the flukes, and can be increased up to the maximum of about 14 pounds if needed. This anchor creates a new level of technology that should be applicable to a very broad range of light watercraft.

DETAILED DESCRIPTION OF THE INVENTION

Figure 1:
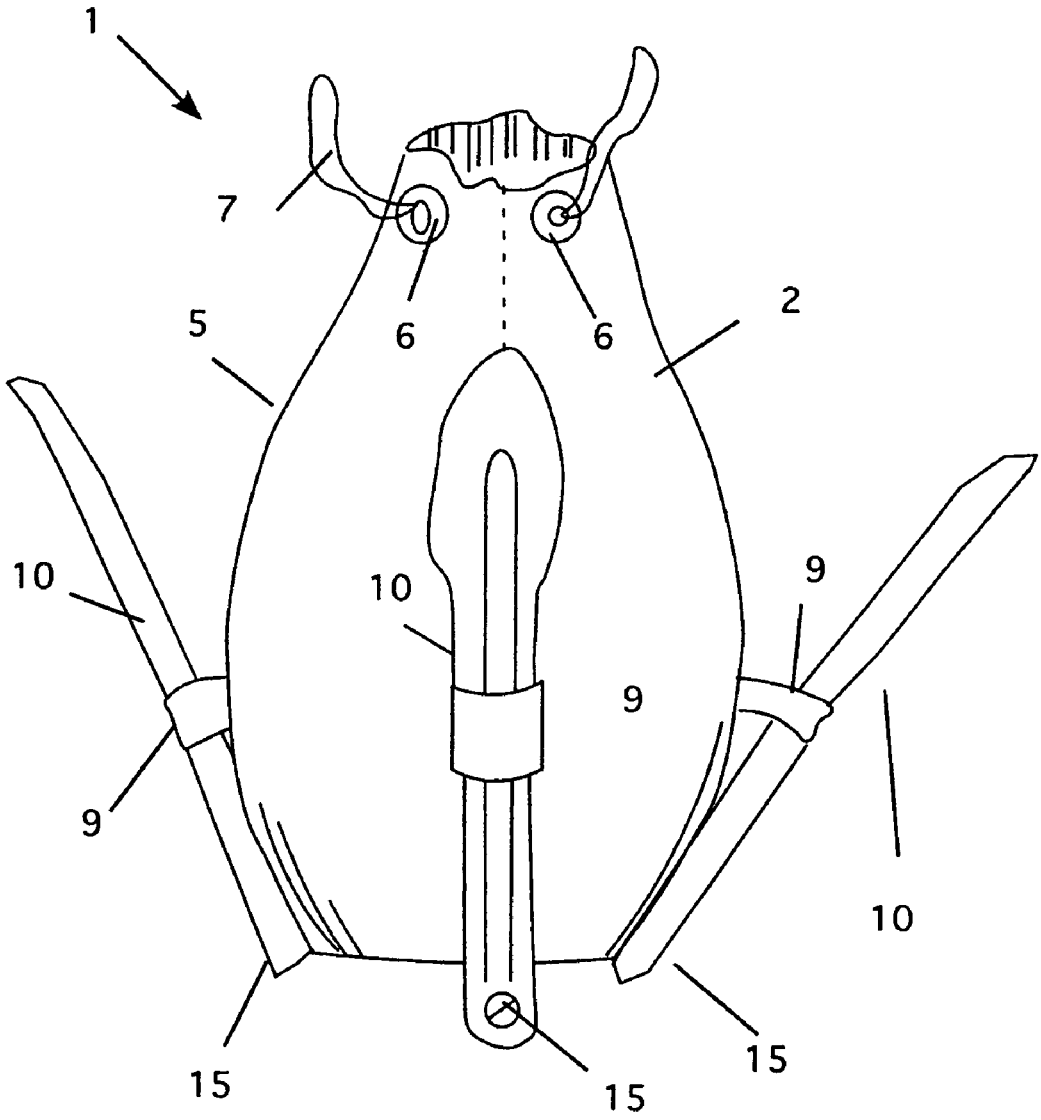
FIG. 1 is a front view of the invention loaded and with the flukes deployed.

The assembled anchor is illustrated in FIG. 1. The materials utilized for this anchor are hard cast flukes and a soft ballast container with associated fabric, webbing, grommets, and heavy drawstring cord for closing the anchor after filling and during use. As shown in FIG. 1, the device 1 has a bag portion 2 and a number of flukes 10. In the preferred embodiment, the number of flukes is 3, although fewer or more can be used, if desired.

The ballast bag 2 is the heart of the device. In the preferred embodiment, it is composed of five pieces of pliable, strong fabric, such as a tight weave polyester mesh. Four of the pieces make up the side panels 5. In the preferred embodiment, three flukes 10 are attached to the panels at their base by fasteners 15 or alternatively, by web straps, as discussed below. To secure the flukes in a generally upright position, lengths of webbing 9 are attached as shown. The webbing wraps around the flukes. As noted, in the preferred embodiment, three flukes can be used; however, fewer or more flukes can be used as desired.

The top of the bag 2 is open. This allows the fill material to be inserted or removed. The top of the bag may be fitted with a length of cord 7 that is used to tie the bag dosed. Grommets 6 are used to secure the cord 7 to the bag. Note that other means of closure may be used as well.

Figure 2:
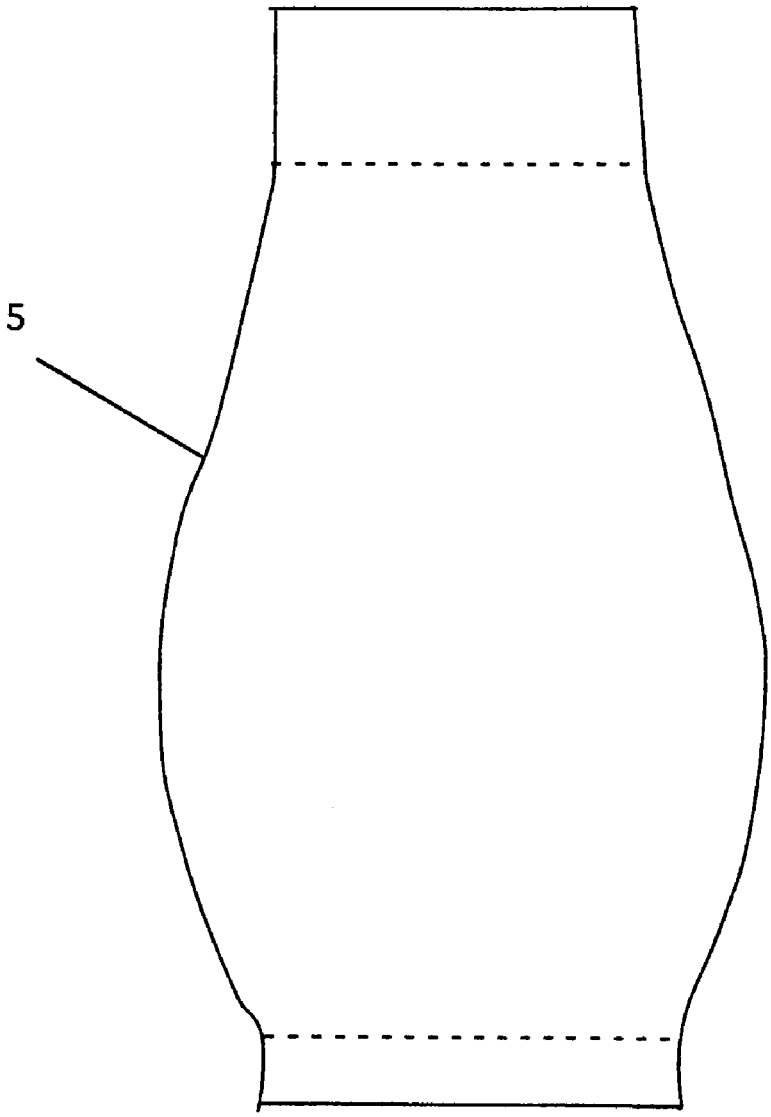
FIG. 2 is a front view of the pattern for one of the panels used to form the bag portion of the anchor.

FIG. 2 shows one of the four side panels 5 of the current size anchor. In the preferred embodiment, each panel is shown as being generally pear-shaped with a rectangular section at the top and bottom. At the top, the rectangular section 5*a* is approximately of 4.5" wide and extends down for about 1.5". This section provides the fabric that is folded down and sewn into a tube at the top of the panel. It forms a strip that is about ¾" high to hold the drawstring 7. After all the four side panels are sewn together, it becomes a reinforced area, through which grommets 6 are punched and the drawstring closure 7 is placed (see FIG. 8 and the discussion below). It can also be used to hold other means of closure as desired. As an alternative, for example, loops can be attached through which a rope can be placed to secure the top closed.

From the bottom of that top straight area 5*a*, each panel is flared to the widest point 5*b*. In the preferred embodiment, that point is located about 4.5" above the bottom of the panel 5*c*. The curve is not critical to function, other than making the panels easier to sew together evenly. At the bottom of the panel is a straight section about ½" long that extends upward from the bottom 5*c*, and finishes the single panel. The bottom straight section is used to make the seam between the side panels and the bottom disk 8 (see FIG. 4).

Figure 3:
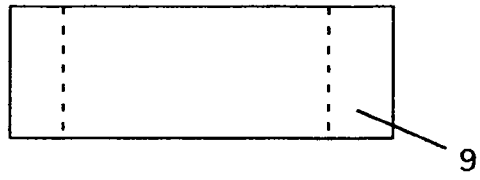
FIG. 3 is a detail view of one of the web straps used to secure the flukes to the bag portion of the anchor.

FIG. 3 shows the pattern for the pieces of webbing 9 that are used to secure the flukes 10 to the side of the container at the widest point as shown. These loops are a means of securing the flukes. These sections of webbing are, in the preferred embodiment, about 3" long, 1" wide, and about ⅛" thick. They can be cut with an electric soldering iron using a heated blade. In using this technique, the end of each cut is thus both hot welded and flared to prevent any possibility of shredding and pulling out of the sewn seam. Of course, any other method common to the art can be used as well. The 3" length permits two ½" ends 9*a* and 9*b* to be sewn inside the bag, leaving a loop of about 2" circumference outside the bag. That loop may vary as needed to accommodate several sizes or styles of fluke.

Figure 4:
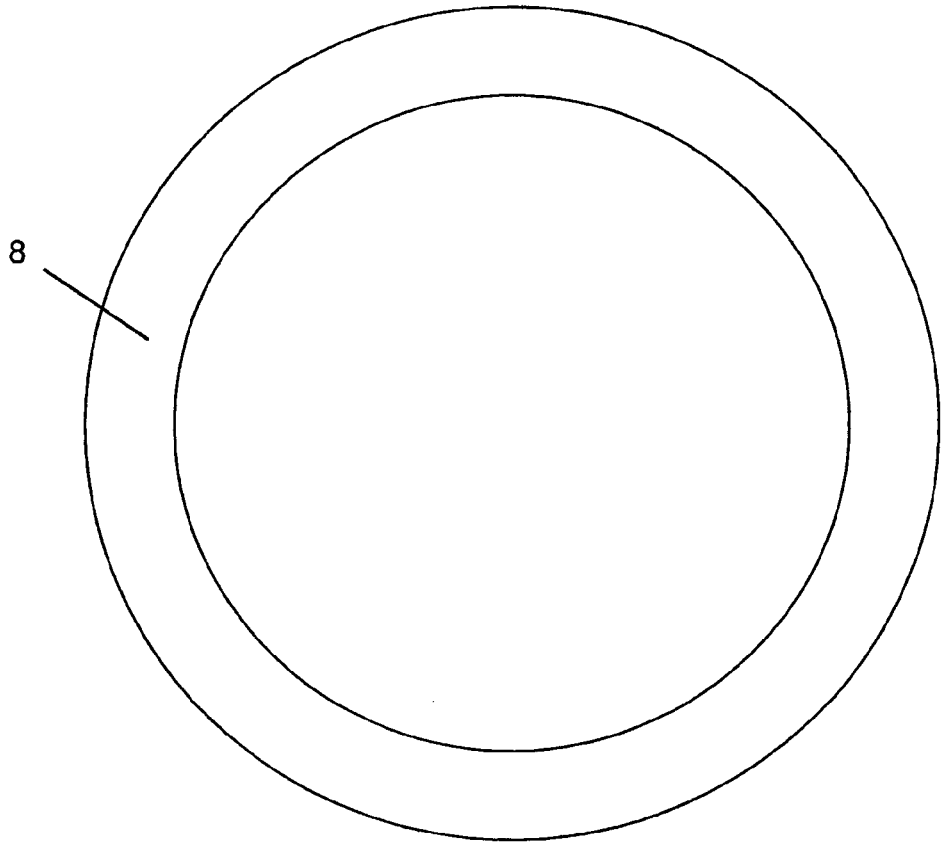
FIG. 4 is top view of the cut pattern for the bottom disk of the bag portion of the anchor.

FIG. 4 is top view of the cut pattern for the bottom disk 8 of the bag portion of the anchor. The fabric disk 8 is sewn to the upper bag portion to create the final piece of the container construction. In the preferred embodiment, the disk 8 has a diameter of about 5.2 inches, which leaves about a ½" rim to form a seam with the bag side panels 5 when the bag is assembled. When completed, the bag has a bottom diameter of about 4 inches.

Figure 5:
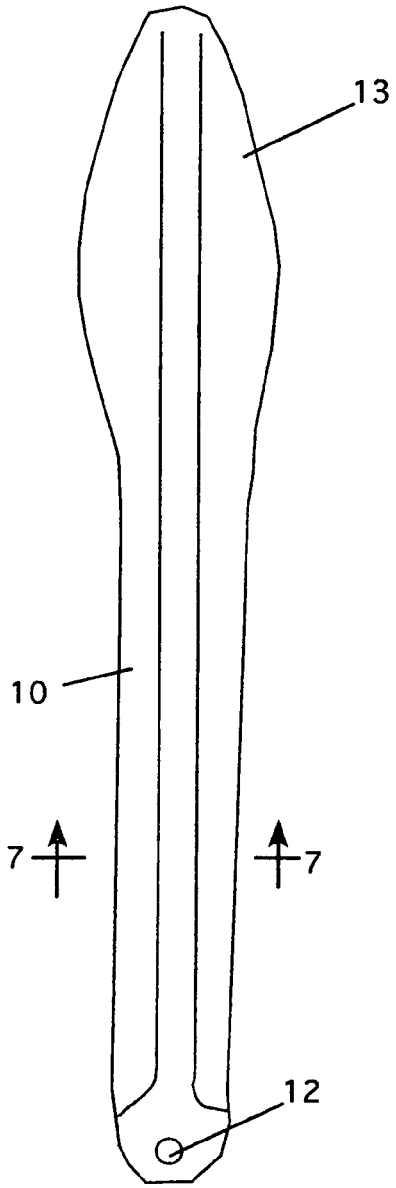
FIG. 5 is a front view of one style of fluke used in the invention.
Figure 6:
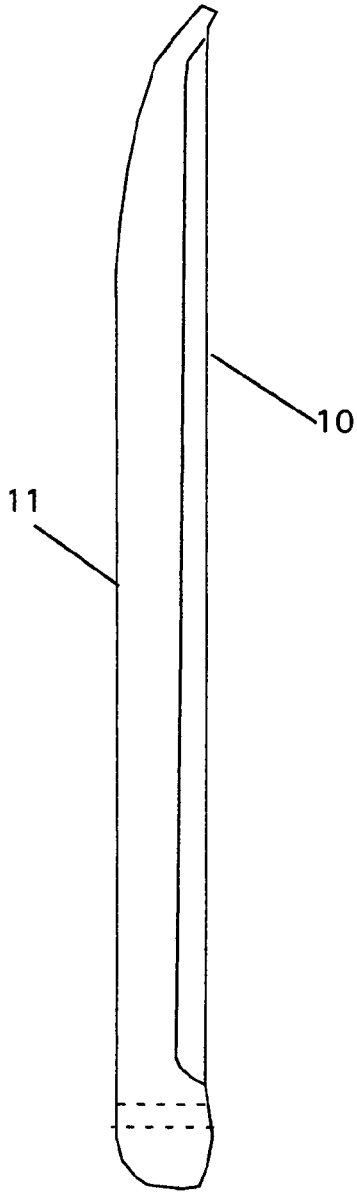
FIG. 6 is a side view of one style of fluke used in the invention
Figure 7:
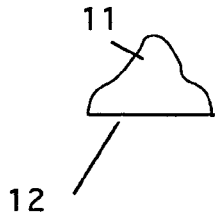
FIG. 7 is a cross-sectional view of a fluke taken along the lines 7-7 of FIG. 5.

The flukes 10 are illustrated in FIGS. 5, 6, and 7. This fluke is an original design created for this anchor. Each fluke is identical. In the preferred embodiment, there are three flukes; however, fewer or more flukes can be used as desired. The flukes can be cast in metal or other material as well as plastic, if desired. In the embodiment shown in FIGS. 5, 6, and 7, each fluke is about 9" long, ¾" wide and ½" thick.

FIG. 5 is a front view of a first embodiment of fluke used in the invention. In this view, the fluke 10 has a top spoon-shaped anchoring tip 13 that gives a wider working surface for holding in soft bottom material. The bottom end of the fluke 10 has a 3/16" hole 12 to accommodate a bolt or rivet. However, this fluke design can also be used with the design shown in FIG. 9 in which webbing attaches the flukes to the bag at a sharp angle.

FIG. 6 is a side view of a fluke used in the invention. In this view, a reinforcing rib 11, which cast into the back side of the fluke to enhance strength, is shown.

FIG. 7 is a cross-sectional view of a fluke, taken along the lower body of the fluke as shown. In this view, the reinforcing rib 11 is also shown.

Figure 8:
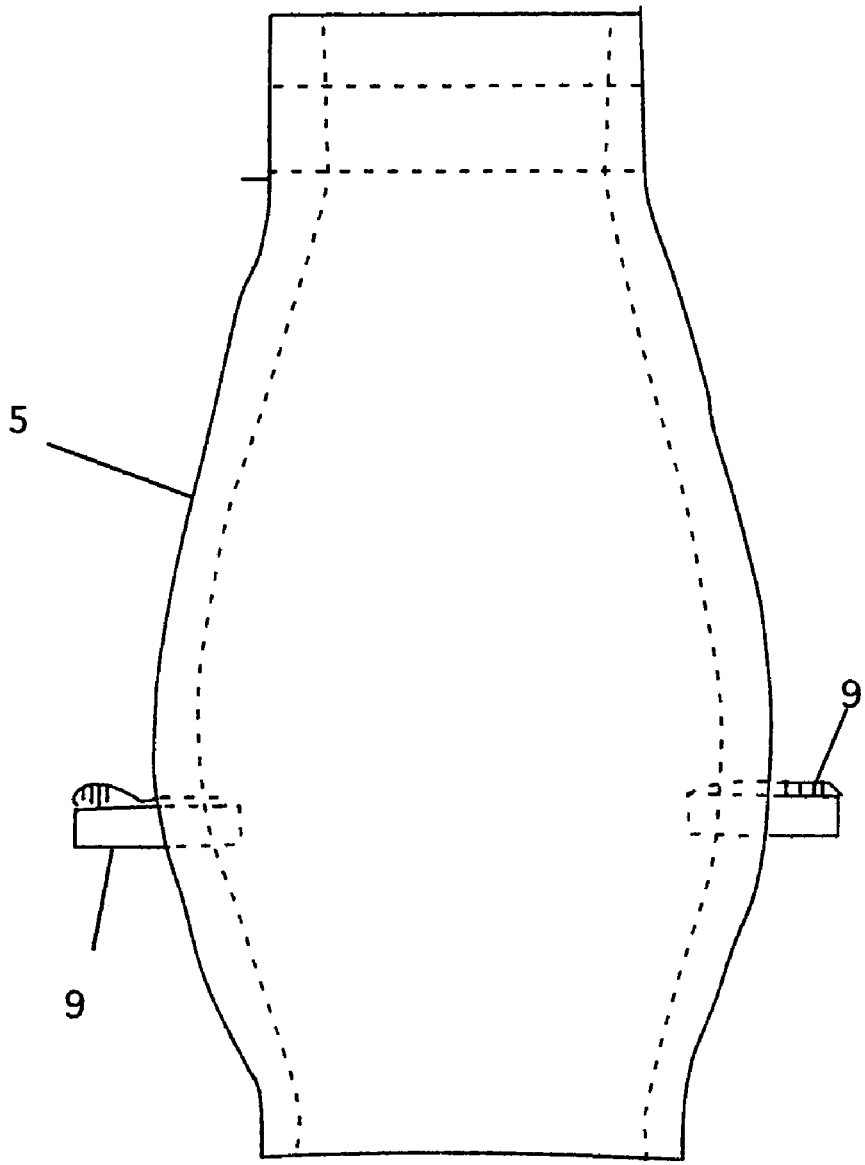
FIG. 8 is a detail showing the sewing pattern for the panels that make up the bag.

FIG. 8 is a detail showing the sewing pattern for the panels that make up the bag. Note that this view shows the webbing 9 sewn in place.

Figure 9:
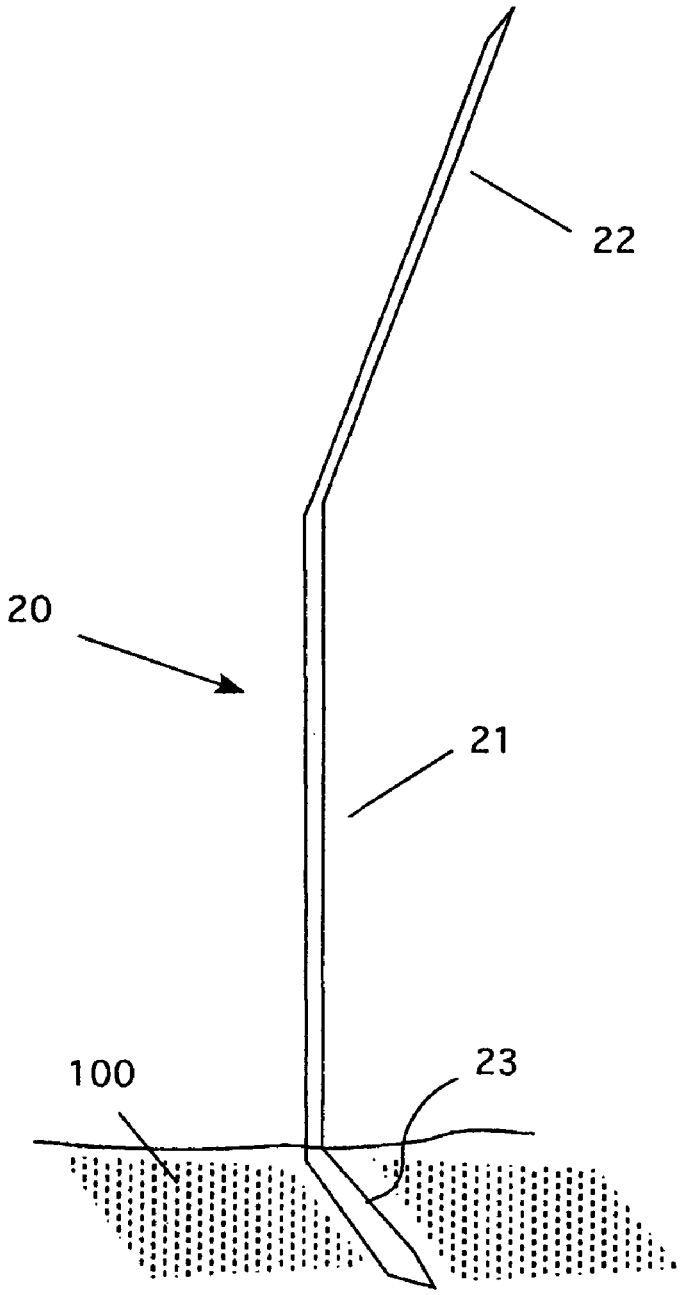
FIG. 9 is a side view of a second fluke design.

FIG. 9 is a detail view of a second fluke design. In this design, the fluke 20 has a straight center portion 21, an angled upper portion 22 and an angled lower portion 23. The lower portion 23 acts as a heel barb that digs into the bottom 100 even when the device is nearly vertical. This ensures proper contact and holding power no matter how the anchor lies on the bottom. This fluke design fluke is about 11" long, ¾" wide and ½" thick.

Figure 10:
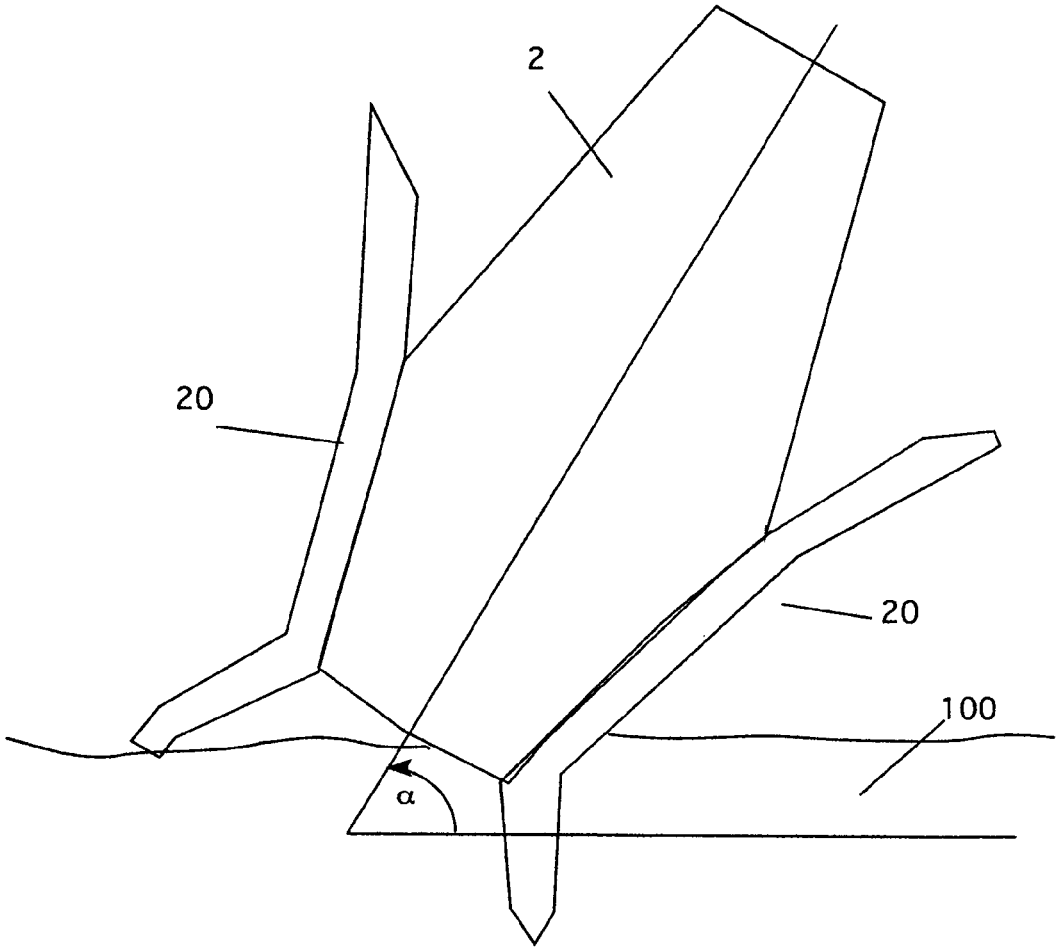
FIG. 10 is a detail of the invention with the second fluke design showing the invention at an almost vertical position with respect to a bottom surface.

FIG. 10 is a detail of the invention with the second fluke design showing the invention at an almost vertical position with respect to a bottom surface. In this figure, the flukes 20 are secured to the bag 2 as shown. Here, the bag lies at an angle $\alpha$ of approximately 75 degrees. Note how the lower end of the fluke embeds in the bottom 100 even in this nearly vertical position.

Figure 11:
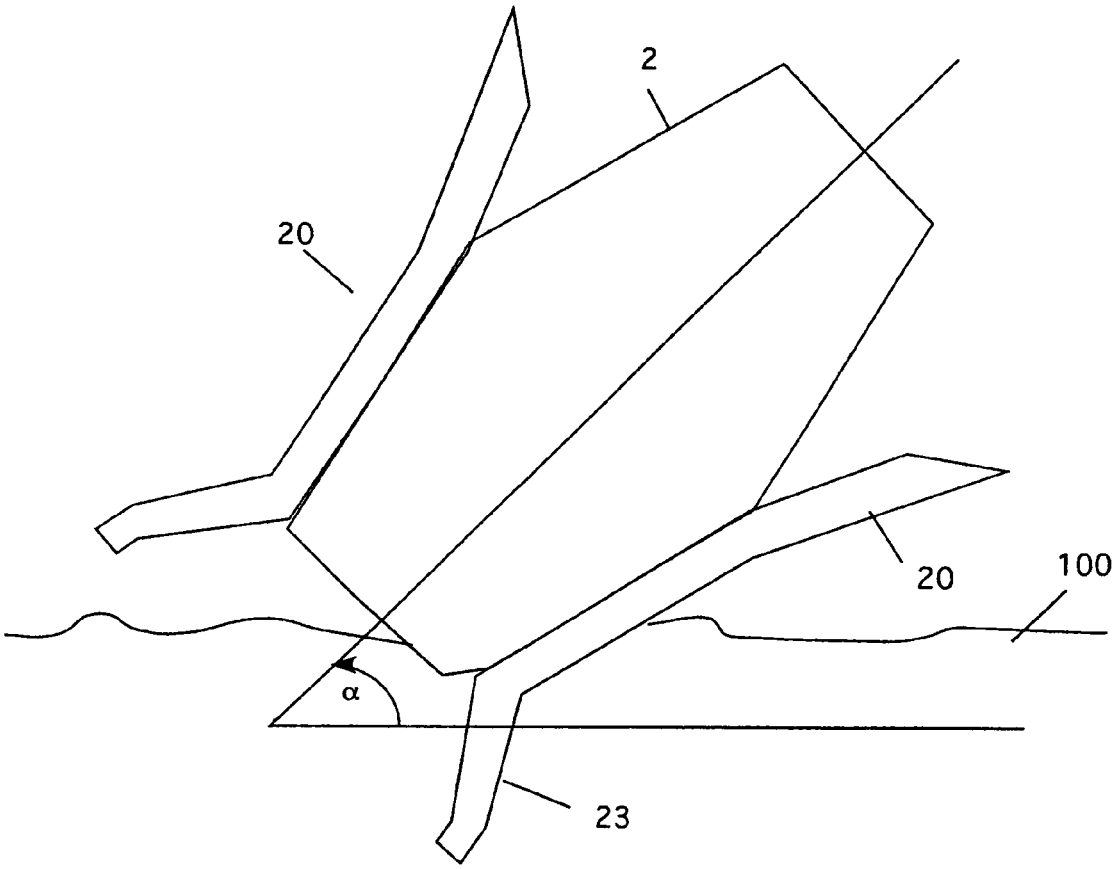
FIG. 11 is a detail of the invention with the second fluke design showing the invention at a 45-degree angle with respect to a bottom surface.
Figure 12:
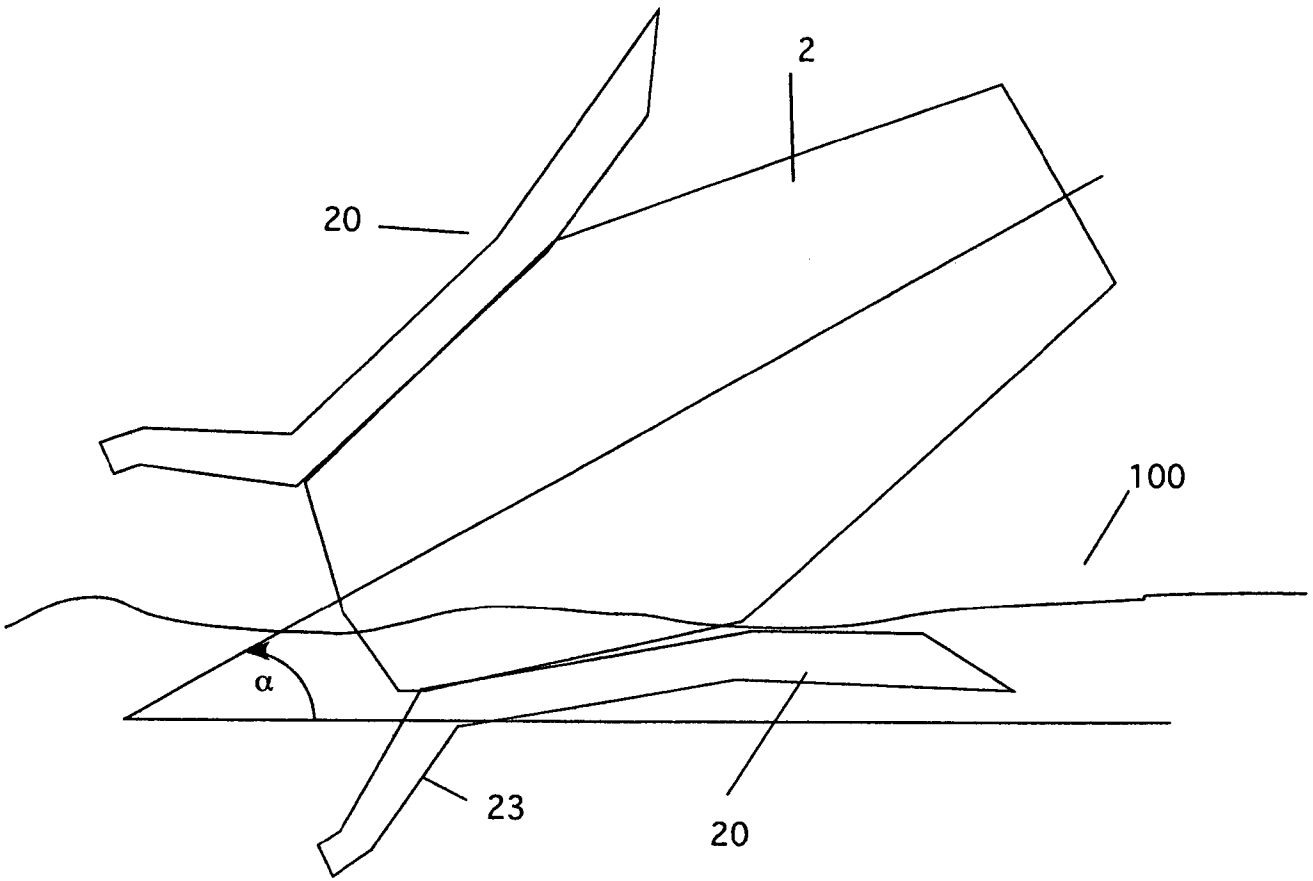
FIG. 12 is a detail of the invention with the second fluke design showing the invention at a 30-degree angle with respect to a bottom surface.

FIG. 11 is a detail of the invention with the second fluke design showing the invention with respect to a bottom surface. In this view, angle $\alpha$ is approximately 45-degrees. At this angle more of the fluke is embedded into the bottom 100, ensuring good holding power for the anchor, FIG. 12 is a detail of the invention with the second fluke design showing the invention with respect to a bottom surface. In this view, angle $\alpha$ is approximately 30-degrees. Note how the entire fluke 20 is embedded into the bottom 100.

Construction of the anchor starts with the sewing of the primary side panels 5 into an irregular, pear-shaped tube. The stitch patterns are detailed in FIG. 8. First, the top of each panel is folded down about 7/10" and sewn flat (to the line marked "a" on FIG. 8. Then each panel is sewn to the adjacent panel by placing two panels back to back, placing the webbing 9 between the panels at the location shown, and stitching (along the dashed lines) all but the last ½" at the bottom. When all sections of fabric and the fluke retention straps are together, the bottom disk 8 is pinned in place using the unsewn ½" flap left at the bottom of all the side panels. The ballast bag can now be turned right side out. Current construction requires 12 brass grommets, with an outside diameter of ½" and an opening of ¼". Around the perimeter of the top, eight grommets are installed in the reinforced fabric tube created in the first sewing step.

Continuing with grommet installation, four are installed around the perimeter of the base, with one installed as close as practical to the joining seam.

The final steps of construction are lacing in the drawstring top cords 7, and fixing the flukes in place. At the top of the anchor bag, two pursing cords 21" long, by ⅛" nylon are laced through the grommets. Once the bag is full, the lacing is tied to provide a means of holding the bag closed.

In one embodiment, at the bottom of the anchor, the grommets have been installed near the side joining seams. The anchor flukes 10 are each slid down through the loop of webbing 9, aligned with the grommet, and a ⅛"×1⅛" bolt 15 installed with a locking nut (not shown). This completes construction. In the other embodiment, the flukes are secured by forcing the web straps into notches formed in the flukes.

Utilization of the anchor, from the stored form, requires turning the ballast container so the flukes are on the outside. Then the container is filled to a usable weight by adding sand, gravel or other means, and drawing the top cord closed. After use, the top closure is released, contents of the container dumped and flushed, and the anchor returned to the stored configuration. When the anchor is out of service, overnight or between trips, the anchor should be cleaned and dried to get maximum life from the components.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. An anchor for small watercraft comprising:

a) a hollow pouch having a bottom, a generally pear-shaped side wall, attached to said bottom, and an open top;

b) a means for closing said open top, operably installed on said pouch;

c) at least one fluke, pivotably attached to said pouch; and d) a means for restraining the movement of said at least one fluke about said pouch.

2. The anchor of claim 1 wherein said fluke has a lower angled portion.

3. The anchor of claim 1 wherein the means for closing said open top include a drawstring.

4. The anchor of claim 1 wherein the means for restraining the movement of said at least one fluke comprise a strap, secured to said pouch and said fluke whereby said strap restrains the pivoting movement of said fluke.

5. The anchor of claim 1 further comprising a means of ballasting said anchor, removably installed in said pouch.

6. The anchor of claim 5 wherein the means for ballasting are selected from the group of: sand, pebbles and small rocks.

7. An anchor for small watercraft comprising:

a) a hollow pouch having a bottom, a generally pear-shaped side wall, attached to said bottom, and an open top;

b) a means for closing said open top, operably installed on said pouch;

c) three flukes, pivotably attached to said pouch; and d) a means for restraining the movement of said three flukes about said pouch.

8. The anchor of claim 7 wherein each of said three flukes has a lower angled portion.

9. The anchor of claim 7 wherein the means for closing said open top include a drawstring.

10. The anchor of claim 7 wherein the means for restraining the movement of said at least one fluke comprise three straps, each of said three straps being secured to said pouch and to one of said three flukes whereby each of said straps restrains the pivoting movement of one of said three flukes.

11. The anchor of claim 7 further comprising a means of ballasting said anchor, removably installed in said pouch.

12. The anchor of claim 11 wherein the means for ballasting are selected from the group of: sand, pebbles and small rocks.

13. The anchor of claim 7 further comprising means for pivotably attaching the three flukes to said pouch.

14. The anchor of claim 13 wherein the means for attaching the three flukes comprises a set of mechanical fasteners.

* * * * *